US005599221A

United States Patent [19]

Gabriel

[11] Patent Number: 5,599,221

[45] Date of Patent: Feb. 4, 1997

[54] CONNECTORS FOR JOINING CONSTRUCTION TOY JOINT ELEMENT AND BRICK

[75] Inventor: Richard J. Gabriel, Portland, Oreg.

[73] Assignee: Matrix Toys, Ltd., Portland, Oreg.

[21] Appl. No.: 499,387

[22] Filed: Jul. 7, 1995

[51] Int. Cl.[6] ..... A63H 33/08

[52] U.S. Cl. ..... 446/128; 446/124

[58] Field of Search ..... 446/128, 120, 446/121, 122, 124, 126

[56] References Cited

U.S. PATENT DOCUMENTS

| | | | |
|---|---|---|---|
| 4,129,975 | 12/1978 | Gabriel | 52/648 |
| 4,159,592 | 7/1979 | Gabriel | 446/121 |
| 4,764,144 | 8/1988 | Lyman | 446/128 |
| 5,259,803 | 11/1993 | Lyman | 446/120 X |

*Primary Examiner*—Mickey Yu
*Attorney, Agent, or Firm*—Chernoff, Vilhauer, McClung & Stenzel

[57] ABSTRACT

Connectors for joining a ball element having multiple facets, each facet defining a joint opening, to a toy brick include at least two projections in spaced relationship with each other mounted on a base. The projections are in releasable frictional engagement with the joint opening. A female connector frictionally engages with a male face of a brick. The female connector includes a set of four prongs, each having gripping sides, projecting symmetrically outward from the base. Adjacent gripping sides of adjacent prongs frictionally grip cylindrical protrusions of the male face. A male connector may join with a brick having a female face with symmetrically arranged gripping surfaces. The male connector frictionally engages a female side of a brick. The male connector includes a set of four prongs, projecting symmetrically downward from the base. Each of the prongs has exterior gripping surfaces for frictionally engaging gripping surfaces of the female face.

6 Claims, 2 Drawing Sheets

CONNECTORS FOR JOINING CONSTRUCTION TOY JOINT ELEMENT AND BRICK

BACKGROUND OF THE INVENTION

The present invention relates to connectors for joining a toy joint element to a brick.

Construction sets for constructing three-dimensional geometrical configurations, molecular models, display structures, furniture, toys, buildings and bridges, and other assemblies by means of joint elements and interconnected struts are legion in the prior art. One such set is the construction set having clip fasteners disclosed in U.S. Pat. No. 4,129,975, assigned to applicant's assignee, the disclosure of which is hereby incorporated herein by reference. U.S. Pat. No. 4,129,975 discloses a plurality of hollow twenty-six (26) faceted toy joint elements with the facets being arranged in a selected orientation. Each facet defines a joint opening which is configured for receiving an elongate strut for interconnecting a plurality of the joint elements to form a three-dimensional framework. The struts have clip fasteners at each end adapted for snap fitting engagement within the joint openings such that they are not separable merely by application of tensile force to the struts; and locking means are provided for preventing inadvertent disengagement of the struts from the joints.

Another known construction set includes elements having a male face generally having multiple symmetrically arranged cylindrical protrusions on a generally flat surface. Other elements have a female face having gripping surfaces to grip, and thereby mate with, the cylindrical protrusions of the male face. One basic element of this construction set is a six-sided toy brick which includes both male and female faces arranged on opposite sides of the brick. The female face of this basic brick element has gripping surfaces which include the inner surfaces of four side walls and the outer surface of at least one tubular protrusion arranged symmetrically between the side walls.

What is needed, then, are connectors which enable the joining of the toy joint element to the toy brick. More specifically, what is needed is a connector to join the toy joint element to a male face of a toy brick and a connector to join the toy joint element to a female face of a toy brick.

SUMMARY OF THE INVENTION

The present invention relates to connectors for joining a toy joint element of a construction set to a toy brick. The joint element defines at least one joint opening having an inner circumference. Each connector preferably includes a gripping element defining an exterior circumference which corresponds to the inner circumference of the joint opening. Accordingly, the gripping element is in releasable frictional engagement with the joint opening. Each connector further includes a brick connecting element on the base for frictionally engaging the brick.

In a female embodiment of the invention, a female connector may join with a brick having a male face with multiple cylindrical protrusions. This female connector includes prongs, which are preferably in sets of four, which project outward from the base. The prongs may be perpendicular to each other and perpendicular to the projections. The prongs of the female embodiment preferably have concave gripping sides. Adjacent gripping sides of adjacent prongs frictionally grip a cylindrical protrusion of the male face.

In a male embodiment of the invention, a male connector may join with a brick having a female face with gripping surfaces. The male connector includes prongs, which may be in sets of four, which project in a first direction from the base. The prongs may be parallel to the projections which project in a second direction from the base. Finally, each of the prongs has exterior gripping surfaces for frictionally engaging the gripping surfaces of the female face.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
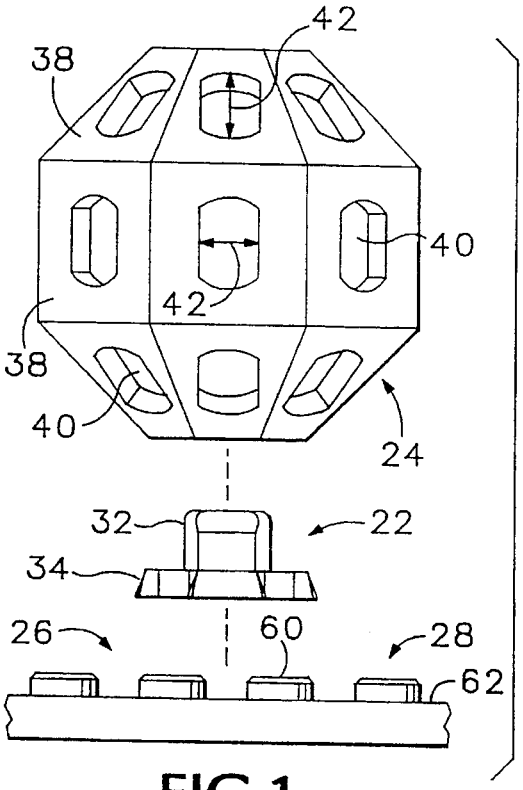
FIG. 1 is an exploded front view of a female connector of the present invention in relation to a toy joint element and a male face of a toy brick.

An exemplary embodiment comprises male and female connectors, indicated generally as 20 and 22, for joining a toy joint element to a toy brick 26. The joint element is shown as a hollow ball 24, but it could be a ring, a hemispherical ball, a panel, or almost any geometrically shaped body. The brick 26 may have either or both a male face 28 and female face 30. The female connector 22, shown in FIGS. 1–5, includes a ball interface 32 and a female brick interface 34 to engage with the male face 28 of the brick 26. The male connector 20, shown in FIGS. 6–10, includes the ball interface 32 and a male brick interface 36 to engage with the female face 30 of the brick 26.

Figure 6:
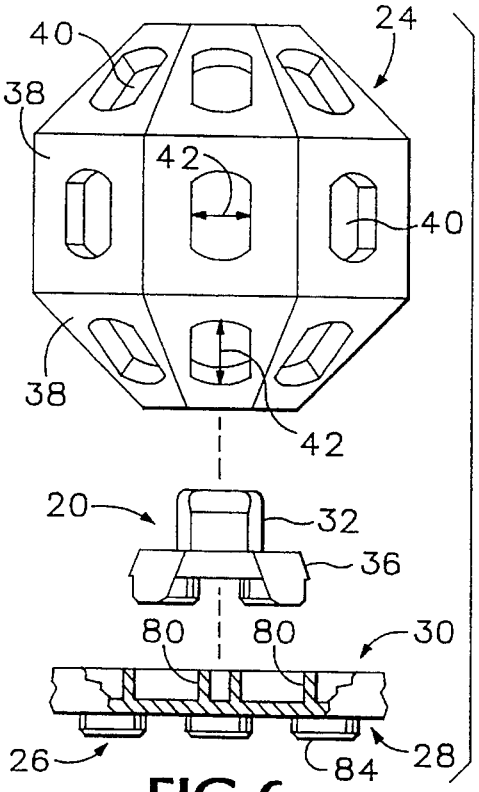
FIG. 6 is an exploded front view of a male connector of the present invention in relation to a toy joint element and a female face (partially cut-away) of a toy brick.
Figure 7:
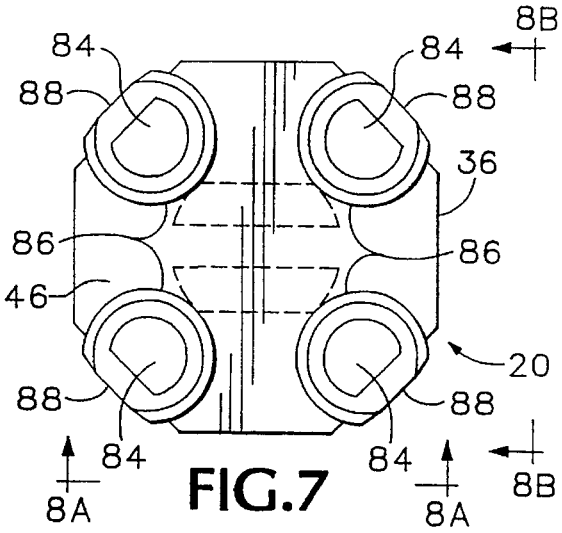
FIG. 7 is a bottom plan view of the male connector of the present invention.
Figure 8A:
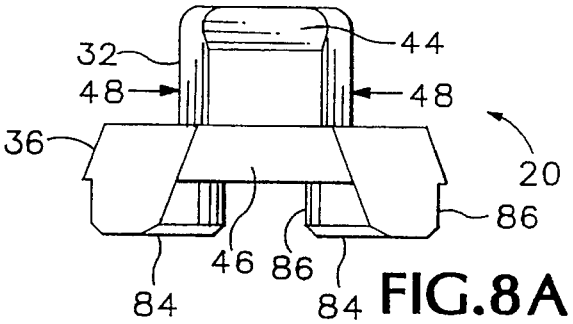
FIG. 8A is a front view of the male connector taken along line 8A—8A of FIG. 7.

FIGS. 1 and 6 show a ball 24 which is disclosed in U.S. Pat. No. 4,129,975, which is assigned to applicant's assignee and incorporated herein by reference. According to U.S. Pat.

No. 4,129,975, ball 24 is a hollow joint element having twenty-six (26) facets which are essentially symmetrically arranged. Each facet 38 defines a joint opening 40 which is configured for receiving the elongate struts (not shown) described in U.S. Pat. No. 4,129,975or the ball interface 32 described herein. Each joint opening 40 has an inner circumference 42 which may be oblong, circular, or of another shape.

The ball interfaces 32 (shown in detail in FIGS. 3A, 3B, 8A, and 8B) of the male and female connectors (20 and 22) are identical. Each ball interface 32 or gripping element preferably includes at least two projections 44 in spaced relationship with each other mounted on a base 46. Alternatively, the ball interface 32 may be a single projection (not shown). The projections 44 together have an exterior circumference 48 corresponding to the inner circumference 42 of at least one joint opening 40 so that the projections 44 may frictionally engage the inner circumference 42 of a joint opening 40. The projections 44 may be slightly flexible.

Each projection 44 preferably includes a shaft 50 and a tip 52. The shaft 50 adjoins base 46. The tip 52 adjoins the shaft 50 at the end opposite base 46. The exterior surfaces of the shaft 50 of the projections 44 cumulatively define the exterior circumference 48 which corresponds to the inner circumference 42 of the joint openings 40. Tip 52 is preferably tapered at approximately a 10° angle downward from an interior surface 54. Tip 52 is preferably approximately one-third the length of projection 44. Tip 52 allows shaft 50 to easily enter joint opening 40.

Each projection 44 preferably includes at least one interior flat surface 54 (FIGS. 3B and 8B) which is in a parallel, spaced relationship with at least one other projection 44 so that the interior surfaces 54 face each other. The base 46 may include a groove 56 which at least partially spans the distance between the flat surfaces 54 of projections 44. Groove 56 provides improved flexibility of base 46 and aids in reducing stress concentration between base 46 and projections 44.

Figure 5:
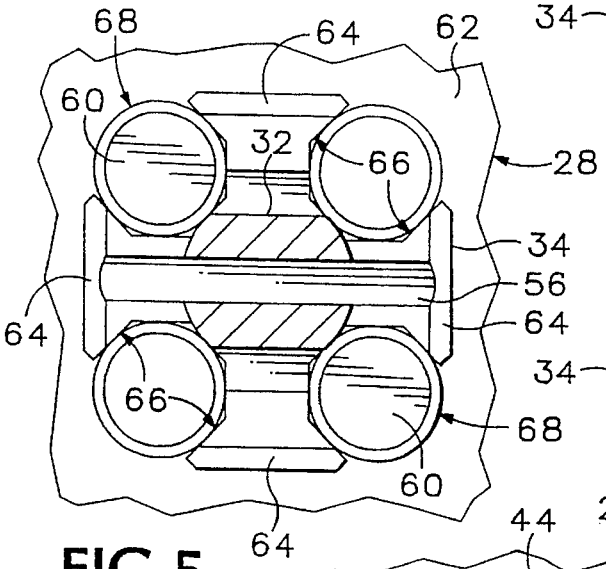
FIG. 5 is a partial cut-away view of the female connector mated with a toy joint element and a male face of a toy brick taken along line 5—5 of FIG. 4.
Figure 4:
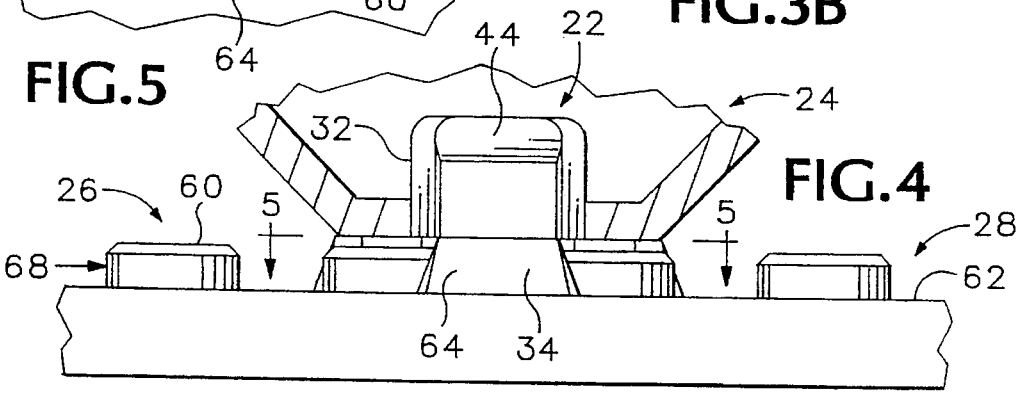
FIG. 4 is a detail view of the female connector mated with a toy joint element (partially cut-away) and a male face of a toy brick.

FIGS. 1, 4, and 5 show elements 26 (generically called bricks) having a male face 28 generally having a plurality of cylindrical protrusions 60 on a generally flat surface 62. It should be noted that the cylindrical protrusions 60 are usually symmetrically arranged. It should also be noted that elements 26 may include only a single protrusion 60.

As discussed above, the female connector 22, shown in FIGS. 1–5, includes a ball interface 32 (described above) and a female brick interface 34 to engage with the male face 28 of the brick 26. The female brick interface 34 preferably includes a plurality of female prongs 64, arranged around base 46, which frictionally engage a male face 28.

Figure 2:
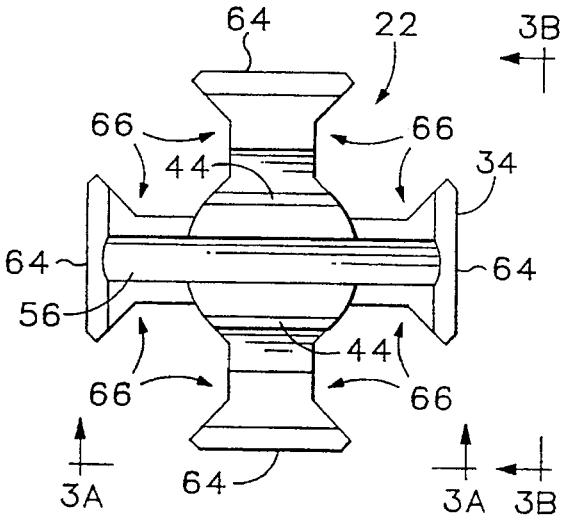
FIG. 2 is a top plan view of the female connector of the present invention.
Figure 3A:
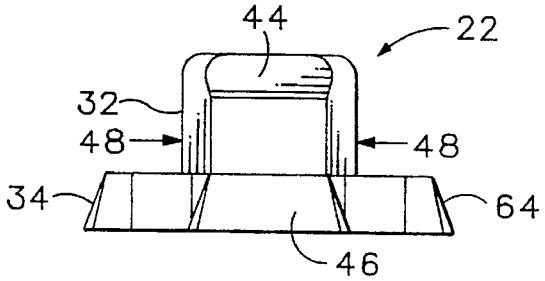
FIG. 3A is a front view of the female connector taken along line 3A—3A of FIG. 2.
Figure 3B:
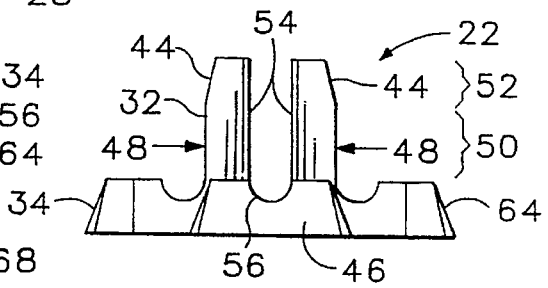
FIG. 3B is a side view of the female connector taken along line 3B—3B of FIG. 2.

In one embodiment, the female prongs 64 project symmetrically outward from base 46 in an X-type shape. Alternatively, female prongs 64 form base 46. The female prongs 64 are preferably arranged perpendicular to each other and perpendicular to the projections 44 of the ball interface 32. Preferably, each of the prongs 64 has concave gripping sides 66. Adjacent gripping sides 66 may define an approximate partial polygon. For example, as shown in FIG. 2, adjacent gripping sides 66 approximately define five (5) sides of an octagon.

As shown in FIGS. 4 and 5, adjacent gripping sides 66 of adjacent prongs 64 frictionally grip the cylindrical protrusions 60 of a male face 28. Accordingly, adjacent gripping sides 66 come into contact with the outer circumference 68 of the cylindrical protrusions 60 at at least two points. For example, as shown, adjacent gripping sides 66 contact the outer circumference 68 at five points. Alternately, the gripping sides 66 may be constructed to exactly mate with the outer circumference 68.

Figure 10:
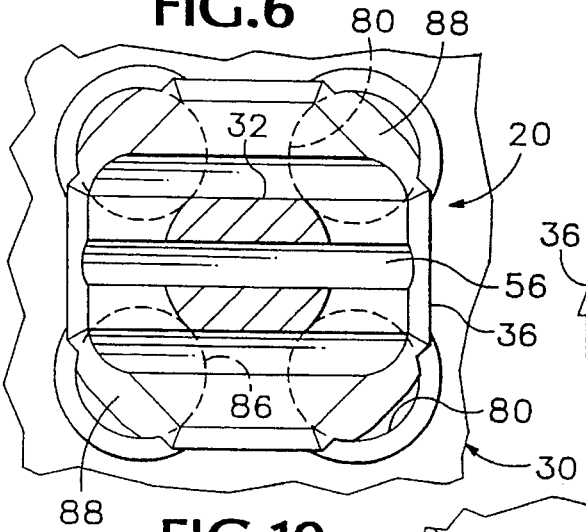
FIG. 10 is a partial cut-away view of the male connector mated with a toy joint element and a female face of a toy brick taken along line 10—10 of FIG. 9.
Figure 8B:
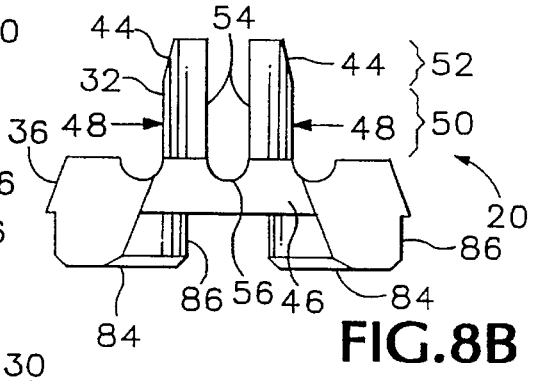
FIG. 8B is a side view of the male connector taken along line 8B—8B of FIG. 7.
Figure 9:
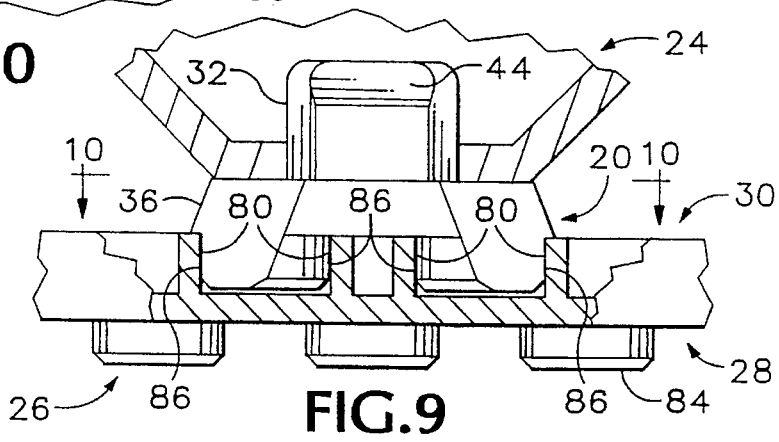
FIG. 9 is a detail view of the male connector mated with a toy joint element (partially cut-away) and a female face (partially cut-away) of a toy brick.

FIGS. 6 and 10 show elements 26 (generically called bricks) having a female face 30 having gripping surfaces 80 to grip, and thereby mate with, the cylindrical protrusions 60 of a male face.

As discussed above, the male connector 20, shown in FIGS. 6–10, includes the ball interface 32 (described above) and a male brick interface 36 to engage with the female face 30 of the brick 26. The male brick interface 36 includes a plurality of male prongs 84, arranged around the base 46, which frictionally engage a female face 30.

In one embodiment, the male prongs 84 project in a first direction from the base 46. The projections 44 of the ball interface 32 project in a second direction from the base 46. If the first direction is opposite the second projection, the male prongs 84 will be parallel to the projections 44. It should be noted, however, that the first direction may be at an angle to said second direction.

Preferably, each of the male prongs 84 has an exterior gripping surface 86 for frictionally engaging a gripping surface 80 of the female face 30. The exterior gripping surface 86 of each male prong 84 comes into contact with the gripping surfaces 80 of the female face 30 at one or more gripping point. As shown, the exterior gripping surfaces 86 of four (4) male prongs 64 frictionally grip a central, cylindrical gripping surface 80.

Additional locations along the male prongs 84 may frictionally engage additional female gripping surfaces 80. For example, FIG. 10 shows the male prongs 84 frictionally gripping the central, cylindrical gripping surfaces 80. Further, FIG. 10 shows the outer exterior surfaces 86 of the male prongs 84 gripping the outer gripping surfaces 80 of the female face 30.

It should be noted that the male prongs 84 may be slightly tapered at the top opposite the base 46 to permit easier entry into the female face 30. Further, the prongs 84 may have at least one flat surface 88 which may be tapered.

It should be noted that brick elements 26 may include either a male face 28, a female face 30, or both. Further, although common elements 26 are brick shaped, alternate shapes are herein included.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A female connector for joining a joint element to a toy brick, said joint element defining at least one joint opening having an inner circumference, said brick having a male face with multiple symmetrically arranged cylindrical protrusions, said connector comprising:

(a) a base;

(b) at least two projections which are mounted in spaced relationship with each other on said base, said projections together defining an exterior circumference corresponding to the inner circumference of said joint opening, said projections for frictionally engaging the inner circumference of said joint opening;

(c) a plurality of prongs which project radially outward from and beyond said base, said prongs being perpendicular to each other and perpendicular to said projections;

(d) wherein adjacent prongs are for frictionally griping the cylindrical protrusions of said male face; and (e) said base defines the intersection of said projections and said prongs.

2. The female connector of claim 1 wherein said prongs are coplanar with said base.

3. The female connector of claim 1 wherein each of said prongs includes concave gripping sides, wherein adjacent concave gripping sides are for frictionally gripping the cylindrical protrusions of said male face.

4. The female connector of claim 1 wherein said adjacent prongs are for frictionally engaging the cylindrical protrusions of said male face at at least two points.

5. The female connector of claim 1 wherein said projections are flexible.

6. The female connector of claim 1, each said projection further comprising:

(a) a shaft adjacent said base, the shafts of said projections defining the exterior circumference corresponding to the inner circumference of said joint opening; and (b) a tip adjacent said shaft and opposite said base, said tip being tapered.

* * * * *